United States Patent [19]

Hileman

[11] Patent Number: 4,592,174

[45] Date of Patent: Jun. 3, 1986

[54] GUTTER PROTECTOR

[76] Inventor: John Hileman, 4227 Sheridan Rd., Youngstown, Ohio 44514

[21] Appl. No.: 693,462

[22] Filed: Jan. 22, 1985

[51] Int. Cl.[4] ..... E04D 13/00

[52] U.S. Cl. ..... 52/12; 52/14; 210/474

[58] Field of Search ..... 52/11–16; 210/474

[56] References Cited

U.S. PATENT DOCUMENTS

| | | | |
|---|---|---|---|
| 274,393 | 3/1883 | Schaffert | 52/12 |
| 1,597,503 | 8/1926 | Andrews | 52/12 |
| 2,175,521 | 10/1939 | Fry | 52/12 |
| 2,847,949 | 8/1958 | Pond | 52/12 |
| 3,080,682 | 3/1963 | Teutsch | 52/12 |
| 3,351,206 | 11/1967 | Wennerstrom | 52/12 |

FOREIGN PATENT DOCUMENTS

| | | | |
|---|---|---|---|
| 272934 | 1/1965 | Australia | 52/11 |
| 25583 | 11/1969 | Australia | 52/11 |
| 86861 | 5/1977 | Australia | 52/11 |
| 563208 | 9/1958 | Canada | 52/12 |

*Primary Examiner*—Carl D. Friedman
*Assistant Examiner*—Naoko N. Slack
*Attorney, Agent, or Firm*—Harpman & Harpman

[57] ABSTRACT

A gutter protector for use on rain gutters used on buildings to catch and divert water from the roof provides an adjustable snap-in cover adapted to fit over and enclose the gutter without restricting water flow from the roof to the gutter.

2 Claims, 5 Drawing Figures

GUTTER PROTECTOR

BACKGROUND OF THE INVENTION

1. Technical Field

This invention relates to rain gutter protectors used to cover the open portion of a rain gutter to prevent build up of foreign material within.

2. Description of the Prior Art

Prior art devices of this type have relied on a variety of different designs to enclose the gutter. See for example U.S. Pat. Nos. 274,393, 3,080,682 and 3,351,206.

In U.S. Pat. No. 274,393, an eaves trough is disclosed that is pivoted at the front edge of the gutter and is spaced above the roof.

In U.S. Pat. No. 3,080,682, an eaves trough construction is shown wherein a one-piece gutter has an enclosed upper portion, the edge portion of which has a plurality of openings adjacent the building's roof.

U.S. Pat. No. 3,351,206 discloses a gutter screening structure having a compound curved clip that secures over the outer edge of the standard gutter and provides an attachment channel into which a screen is positioned and extends therefrom to the roof.

Applicant's gutter protector covers the entire open portion of a standard gutter with a one-piece flexible member that engages the front inner edge of the gutter and extends down into the gutter adjacent its opposite surface of the building.

A portion of the gutter protector facing the building is perforated, both above and below the actual roof surface.

SUMMARY OF THE INVENTION

A gutter protector to be attached to a standard gutter to prevent the accumulation of foreign material within the gutter such as leaves in the fall and ice and snow in the winter preventing gutter overflow and the need for seasonal maintenance. The gutter protector encloses the majority of the open portion of the gutter with a non-porous material with perforations or a screened surface portion adjacent the roof providing proper drainage into the gutter.

DESCRIPTION OF THE PREFERRED EMBODIMENT

Figure 1:
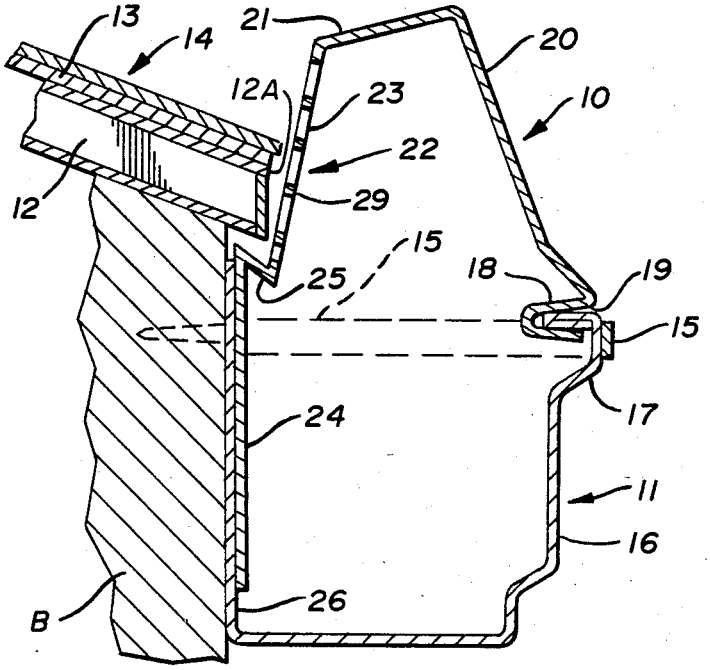
FIG. 1 is a transverse section of the gutter protector within a gutter on a building.
Figure 2:
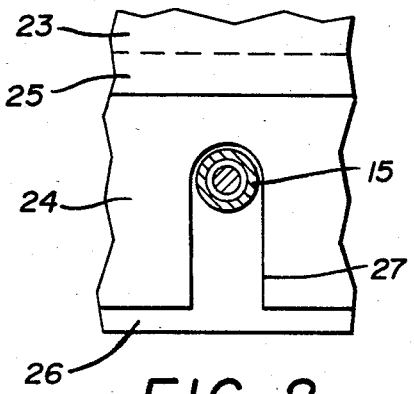
FIG. 2 is a front plan view of a portion of the device secured within a gutter.

Referring to FIGS. 1 and 2 of the drawings, a gutter protector 10 can be seen attached to a gutter 11 secured to a building B having a roof portion 12 with an eave 12A. The roof portion 12 is covered with tar paper 13 and shingles 14 as will be well understood by those skilled in the art. The gutter 11 is attached to the building B by a plurality of spaced spikes and ferrules 15 that extend through supporting the gutter 11 and into the building B. The ferrules act as spacers to maintain the gutter shape. The gutter 11 has a front wall 16 with a front edge lip 17 formed thereon with a portion of the lip 17 folded back upon itself which helps maintain the gutter's shape and gives it rigidity.

The gutter protector 10 comprises a one-piece performed elongated shape having a curved lower edge portion 18 that extends in spaced relation back upon itself defining a channel 19.

The gutter protector has an angularly disposed front wall 20, an integral top 21 and a back wall 22. The back wall 22 is comprised of an upper angularly disposed portion 23 in oppositely disposed relation to said front wall 20 and a lower portion 24 defined by a generally V-shaped angular extension 25. The lower portion extends vertically down into the gutter 11 abutting an inner surface 26 thereof. The angularly disposed portion 23 is perforated along its surface which extends both above the shingle 14 and below the roof portion 12 assuring that water run-off will flow into the gutter 11.

Referring to FIG. 2 of the drawings, an inverted U-shaped notch 27 is formed within the lower portion 24 of the gutter protector and is engaged over and positioned around the spike and ferrule 15. The width of the notch 27 is the same as that of the outer diameter of the spike and ferrule 15 providing a wedging relationship therebetween.

Figure 4:
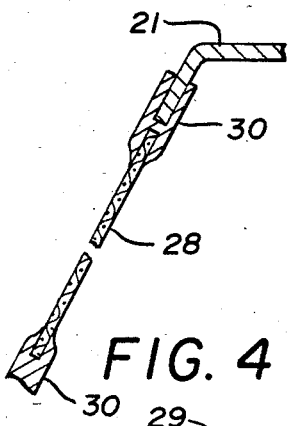
FIG. 4 is an enlarged cross sectional view of a portion of an alternate form of the invention.
Figure 5:
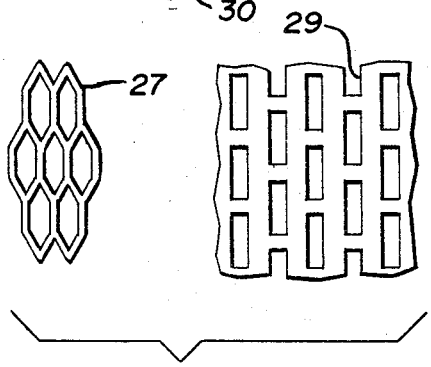
FIG. 5 is an enlarged view of a cutaway portion of the invention showing perforated surfaces and an alternate form of the invention having expanded metal screen.
Figure 3:
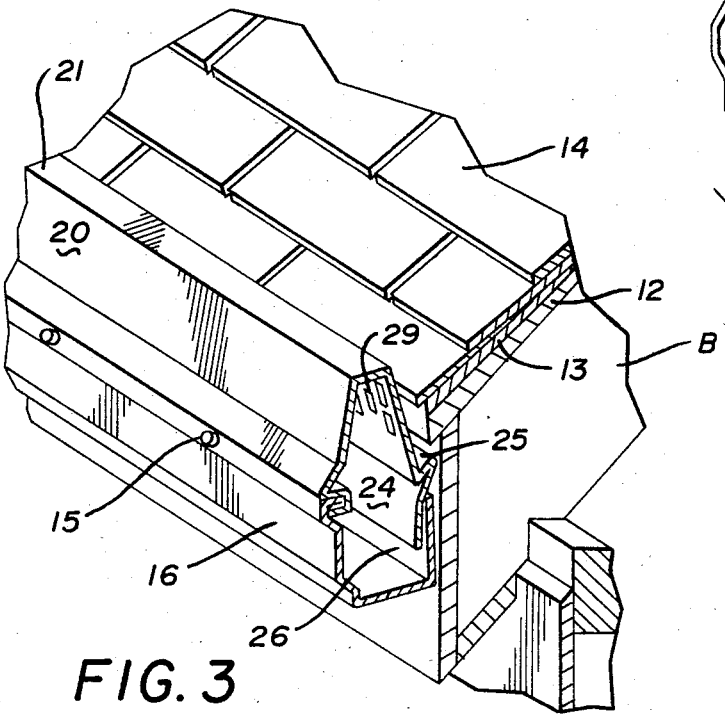
FIG. 3 is a perspective view of the device installed on a gutter with portions cut away.

In FIGS. 4 and 5 of the drawings, an alternate form of the invention is shown wherein a screen insert 28 is used in place of a perforated portion 29 in the upper angularly disposed portion 23. The screen insert 28 is held in place by a pair of oppositely disposed Y-shaped configurations 30 as are well known in the art with the screen insert pressed within.

In use, the gutter protector is positioned on the gutter front edge lip 17 of the gutter 11 and compressed slightly moving the back wall 22 into the gutter 11 as best seen in FIG. 1 of the drawings with the U-shaped notch 27 engaged over the spike and ferrule 15. The wedging relationship of the back wall 22 over the spike and ferrule 15 and the inner surface 26 of the gutter due to the resiliency of the compressed gutter protector holds the same securely within the gutter 11. The gutter protector prevents foreign material from entering the gutter, such as leaves or snow, preventing drainage and ice build-up, etc. The gutter stays clean and with the perforated portion 29 of the angularly disposed 23 allows rain water to freely enter the gutter with the generally V-shaped angular extension 25 providing adequate drip edge protection.

It will thus be seen that a new and novel gutter protector device has been illustrated and described and that various changes and modifications may be made therein without departing from the spirit of the invention and having thus described my invention, what I claim is:

1. A gutter protector, for use on a gutter secured to a building having a roof portion with an eave, comprises a preformed elongated shape having an edge portion defining a channel, an angularly disposed front wall, an integral top and a back wall having a perforated upper portion and a lower portion, said angularly disposed front wall is of a height that is equal to said upper portion of said back wall, and wherein said upper portion of said back wall extends above the eave, means for securing said gutter protector in said gutter, a V-shaped angular extension between said upper and lower portions of said back wall.

2. The gutter protector of claim 4 wherein said means for securing same in said gutter comprises an inverted U-shaped notch in said lower portion of said back wall engageable around and extending downwardly from a spike and ferrule on said gutter.

* * * * *